US010597910B2

(12) United States Patent
Chen et al.

(10) Patent No.: US 10,597,910 B2
(45) Date of Patent: Mar. 24, 2020

(54) UNIVERSAL DOOR LOCK-DRIVING ASSEMBLY

(71) Applicant: Shanghai MingWei Hardware Co., Ltd., Shanghai (CN)

(72) Inventors: Lawrence Chen, Shanghai (CN); You-Gen Ying, Shanghai (CN)

(73) Assignee: SHANGHAI MINGWEI HARDWARE CO., LTD., Shanghai (CN)

( * ) Notice: Subject to any disclaimer, the term of this patent is extended or adjusted under 35 U.S.C. 154(b) by 370 days.

(21) Appl. No.: 15/654,420

(22) Filed: Jul. 19, 2017

(65) Prior Publication Data

US 2017/0314299 A1 Nov. 2, 2017

Related U.S. Application Data

(63) Continuation-in-part of application No. 14/566,905, filed on Dec. 11, 2014, now abandoned.

(51) Int. Cl.

| | |
|---|---|
| ***E05B 65/10*** | (2006.01) |
| ***E05B 85/02*** | (2014.01) |
| ***E05B 79/04*** | (2014.01) |
| ***E05B 79/16*** | (2014.01) |
| *E05B 63/14* | (2006.01) |

(Continued)

(52) U.S. Cl.

CPC ..... *E05B 79/04* (2013.01); *E05B 65/1006* (2013.01); *E05B 79/16* (2013.01); *E05B 85/02* (2013.01); *E05B 9/08* (2013.01); *E05B 63/143* (2013.01); *E05B 65/10* (2013.01); *E05B 65/1046* (2013.01); *E05C 9/20* (2013.01); *Y10T 292/0908* (2015.04)

(58) Field of Classification Search

CPC ..... Y10T 292/0908; Y10T 292/0909; Y10T 292/091; E05B 65/10; E05B 79/04; E05B 79/16; E05B 85/02; E05C 21/00

See application file for complete search history.

(56) References Cited

U.S. PATENT DOCUMENTS

| | | | |
|---|---|---|---|
| 1,539,350 | A | 5/1925 | Clark |
| 2,858,157 | A | 10/1958 | Eichacker |
| 3,347,070 | A | 10/1967 | Gibson |

(Continued)

FOREIGN PATENT DOCUMENTS

EP 2078810 A1 * 7/2009 ..... E05B 63/0056

*Primary Examiner* — Carlos Lugo

(74) *Attorney, Agent, or Firm* — Muncy, Geissler, Olds & Lowe, P.C.

(57) ABSTRACT

A universal door lock-driving assembly is installed in an exterior space of a door panel. The door panel is furnished with at least one of an embedded lock cartridge, an embedded vertical-extending lock bar assembly and an exposed vertical-extending lock bar assembly. The universal door lock-driving assembly includes a base set, an action unit, a driving member and a slidable unit. The slidable unit can assemble a first assembling member and a second assembling member. The first assembling member can apply a penetration slot on the base set to generate interaction with the embedded lock cartridge or the embedded vertical-extending lock bar assembly. The second assembling member can interact with an exposed lock bar. Thus, the universal door lock-driving assembly can be used to unlock at least the lock cartridge and the lock bar assembly.

7 Claims, 16 Drawing Sheets

(51) Int. Cl.
*E05C 9/20* (2006.01)
*E05B 9/08* (2006.01)

(56) References Cited

U.S. PATENT DOCUMENTS 3,490,803 A * 1/1970 Rollins ..... E05C 1/14 292/170
4,007,954 A 2/1977 Erickson
4,295,673 A * 10/1981 Miller ..... E05B 65/1046 292/21
4,741,563 A * 5/1988 Cohrs ..... E05B 65/1046 292/168
4,961,330 A * 10/1990 Evans ..... E05B 47/0603 292/92
4,986,583 A 1/1991 Campbell
5,403,047 A 4/1995 Walls
5,730,478 A 3/1998 D'Hooge
5,829,801 A 11/1998 Tindall
5,947,534 A * 9/1999 Zarzycki, Jr. ..... E05B 65/1053 292/170
6,000,733 A * 12/1999 Linder ..... E05B 65/1046 292/21
6,009,732 A * 1/2000 Haeck ..... E05B 17/06 292/92
6,196,599 B1 3/2001 D'Hooge
6,293,598 B1 9/2001 Rusiana
6,953,211 B2 10/2005 Di Vinadio
7,641,244 B2 * 1/2010 Lin ..... E05B 65/1006 292/92
8,042,843 B2 10/2011 Tien
8,201,857 B2 6/2012 Tien
8,424,928 B2 4/2013 Lin
2010/0066102 A1 * 3/2010 Shen ..... E05B 65/1006 292/92
2013/0076046 A1 3/2013 Shah
2014/0246872 A1 9/2014 Shen

* cited by examiner

UNIVERSAL DOOR LOCK-DRIVING ASSEMBLY

CROSS REFERENCE TO RELATED APPLICATIONS

This application is a Continuation-in-Part of co-pending application Ser. No. 14/566,905 filed on Dec. 11, 2014, for which priority is claimed under 35 U.S.C. § 120, the entire contents of which are hereby incorporated by reference.

BACKGROUND OF THE INVENTION

1. Field of the Invention

The invention relates to a universal door lock-driving assembly, and more particularly to the door lock-driving assembly that can be universally applied to drive either one of an embedded lock cartridge, an embedded vertical-extending lock bar assembly and an exposed vertical-extending lock bar assembly.

2. Description of the Prior Art

Generally, fire doors are common seen in any kind of buildings. While in meeting a fire, the fire door can be manually unlocked for evacuation. Currently, door locks for the fire doors can be classified into embedded lock cartridges, embedded vertical-extending lock bar assemblies, exposed lock bar assemblies extending either vertically or horizontally, horizontal-sliding locks, and three-position turning locks. The embedded lock cartridge, generally mounted inside a door panel of the fire door, provides a locking tongue for locking the fire door by horizontal protruding or by turntable blocking. The embedded vertical-extending lock bar assembly, usually seen to have a pair of lock bars and mounted also inside the door panel, is to move vertically up or down mainly inside the door panel so as to protrude a bar tip thereof out of the door panel to lock the fire door. The exposed lock bar assembly, usually seen to have a pair of lock bars and mounted exteriorly to the door panel, is to move vertically up or down completely outside the door panel for protruding a bar tip thereof beyond the door panel to lock the fire door.

Nevertheless, in order to meet various installation needs, different door lock-driving assemblies shall be applied to drive or control the corresponding door locks in locking/unlocking the respective fire doors. For example, referring to FIG. 1, a conventional door lock-driving assembly installed on a door panel of a fire door is schematically shown. The conventional door lock-driving assembly PA1 mounted on the door panel PA2 includes a depression arm PA11 and a sliding member PA12. As shown, the door panel PA2 is equipped with an exposed lock bar assembly PA3 having a pair of lock bars. Both of the lock rods are coupled with the sliding member PA12 from opposing sides thereof. While the lock bar PA3 in a lock state needs to be retrieved so as to unlock the fire door, the depression arm PA11 is firstly depressed to slide the sliding member PA12 along a sliding direction (not shown herein), and then the bar tip of the lock bar would be retrieved back synchronously to the door panel PA2 so as to present an unlock state. Thus, the fire door is unlocked. It is noted that the sliding direction is perpendicular to the floor surface and performed along an action line of the lock bar.

Referring now to FIG. 2, an embedded vertical-extending lock bar assembly PA4 mounted inside the door panel PA2 is schematically shown. In comparison with the conventional door lock-driving assembly PA1 of FIG. 1 mounted exteriorly to the door panel PA2 to control the exposed vertical-extending lock bar assembly PA3, it is obvious that the embedded vertical-extending lock bar assembly PA4 for the door panel PA2 should need another door lock-driving assembly to control an interior sliding member PA41 for locking or unlocking the fire door. Apparently, in this example, the aforesaid door lock-driving assembly PA1 is no longer suitable to control this interior sliding member PA41. Hence, another type of door lock-driving assemblies shall be introduced to serve more appropriately this embedded vertical-extending lock bar assembly PA4. Empirically, such a change is usually expensive, and thus modification upon pairing of the door lock-driving assembly and different types of door locks is definitely welcome to the art.

SUMMARY OF THE INVENTION

In view of prior art, since different types of door locks need different door lock-driving assemblies to pair, thus shortcomings in application uniqueness and expensive production cost do exist in the art and need to be resolved. Accordingly, it is an object of the present invention to provide a universal door lock-driving assembly, that can maintain original structures of the door lock-driving assembly, that has a penetration slot furnished to a base set and a common slidable unit, and that provides an embedded bar-ward lever to the slidable unit and to movably penetrate the penetration slot so as further to unlock different lock cartridges and lock bars.

In the present invention, the universal door lock-driving assembly is installed in an exterior space of a door panel, the door panel is furnished with at least one of an embedded lock cartridge, an embedded vertical-extending lock bar assembly and an exposed vertical-extending lock bar assembly, the door panel has a through hole, the embedded lock cartridge has a locking tongue and a turning member to drive the locking tongue, the embedded vertical-extending lock bar assembly has at least a first push rod and a rod-driving member for driving the first push rod, and the exposed vertical-extending lock bar assembly has at least one exposed lock bar.

The universal door lock-driving assembly includes a base set, an action unit, a driving member and a slidable unit. The base set, connected with the door panel, has a penetration slot respective to the through hole. The action unit, movably connected with the base set, has an action stroke. The driving member, movably connected with the base set, is located on the action stroke to move along a lever-protruding stroke by the action unit. In addition, the slidable unit, movably connected with the base set, is located on the lever-protruding stroke, and has at least a first assembling member and a second assembling member.

If the door panel is equipped with the embedded lock cartridge, the first assembling member is applied to be fixedly connected with a cartridge-ward lever penetrating through the penetration slot and the through hole. If the door panel is equipped with the embedded vertical-extending lock bar assembly, the first assembling member is applied to be fixedly connected with an embedded bar-ward lever penetrating through the penetration slot and the through hole. If the door panel is equipped with the exposed vertical-extending lock bar assembly, the second assembling member is applied to be fixedly connected with an exposed bar-ward lever. Also, the turning member of the embedded lock cartridge, the rod-driving member of the embedded vertical-extending lock bar assembly, and the lock bar of the exposed vertical-extending lock bar assembly are all located on the lock-sliding stroke. In addition, the driving member drives the slidable unit to move along a lock-sliding stroke.

In one embodiment of the present invention, the slidable unit further includes at least one slidable body and at least one slide-driven bar, the at least one slidable body being furnished with at least one stroke-limiting slot, the at least one slide-driven bar being connected with the at least one slidable body. The base set includes a basic plate and a mounting structure. The action unit is movably connected with the basic plate. The mounting structure, fixed to the basic plate and located in the slidable unit, is furnished with a position-limiting pin penetrating the stroke-limiting slot so as to limit the lock-sliding stroke of the slidable unit. In addition, the action unit includes an acting portion, a pivotal portion and a depression portion. The acting portion is to be depressed to move pivotally the the action unit. The pivotal portion, connected with the acting portion, is pivotally mounted to the basic plate. The depression portion, connected with the pivotal portion, is to push the driving member. As the acting portion is depressed, the depression portion is moved pivotally about the pivotal portion along the action stroke to push the driving member, and then the driving member moves along the lever-protruding stroke to drive the slide-driven bar and the slidable unit to displace along the lock-sliding stroke.

In one embodiment of the present invention, the depression portion is located between the basic plate and the slidable unit, the lever-protruding stroke is a turning stroke, and the lock-sliding stroke is parallel to the door panel.

Thus, by adopting the universal door lock-driving assembly provided by the present invention, it is obvious that the slidable unit of the universal door lock-driving includes the first assembling member to assemble optionally the cartridge-ward lever or the embedded bar-ward lever. Also, since either of the cartridge-ward lever and the embedded bar-ward lever is movable to penetrate both the penetration slot additional to the base set and the through hole additional to the door panel, thus each of which can be extended to drive the locking tongue or the lock bar for performing locking or unlocking of the door panel. In addition, the slidable unit can assemble the exposed bar-ward lever to drive the exposed lock bar. Thereupon, the universal door lock-driving assembly provided in the present invention can be universally applied to at least three aforesaid door locks, and thus the aforesaid shortcomings in the conventional designs can be effectively resolved.

All these objects are achieved by the universal door lock-driving assembly described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a universal door lock-driving assembly. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Though various embodiments can be organized in accordance with the present invention, yet only three of them, accompanied by drawings, are raised in the following description to elucidate the present invention.

Figure 1:
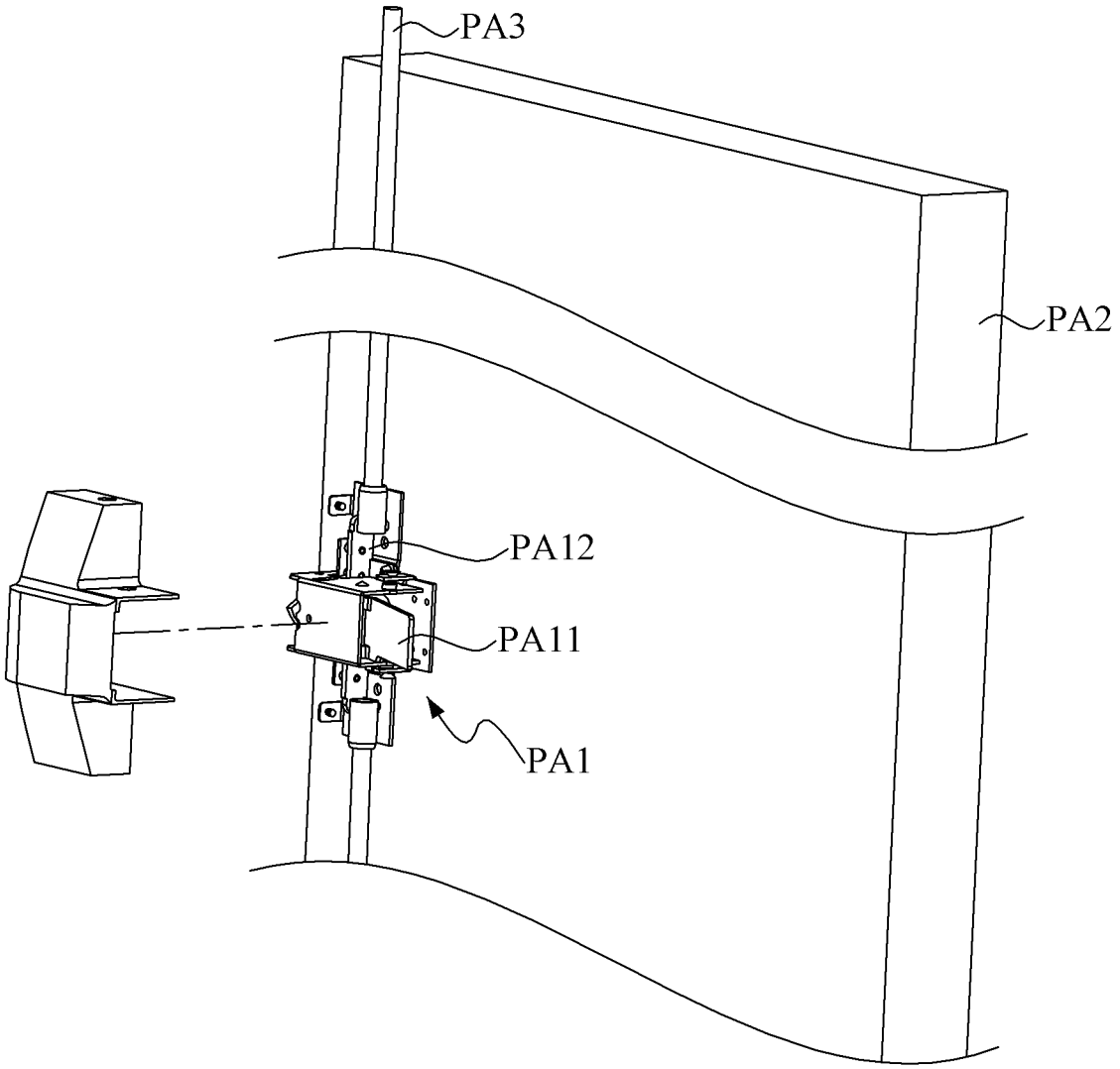
FIG.1(Prior Art)
FIG. 1 is a schematically perspective view of a conventional door lock-driving assembly installed on a door panel of a fire door.
Figure 2:
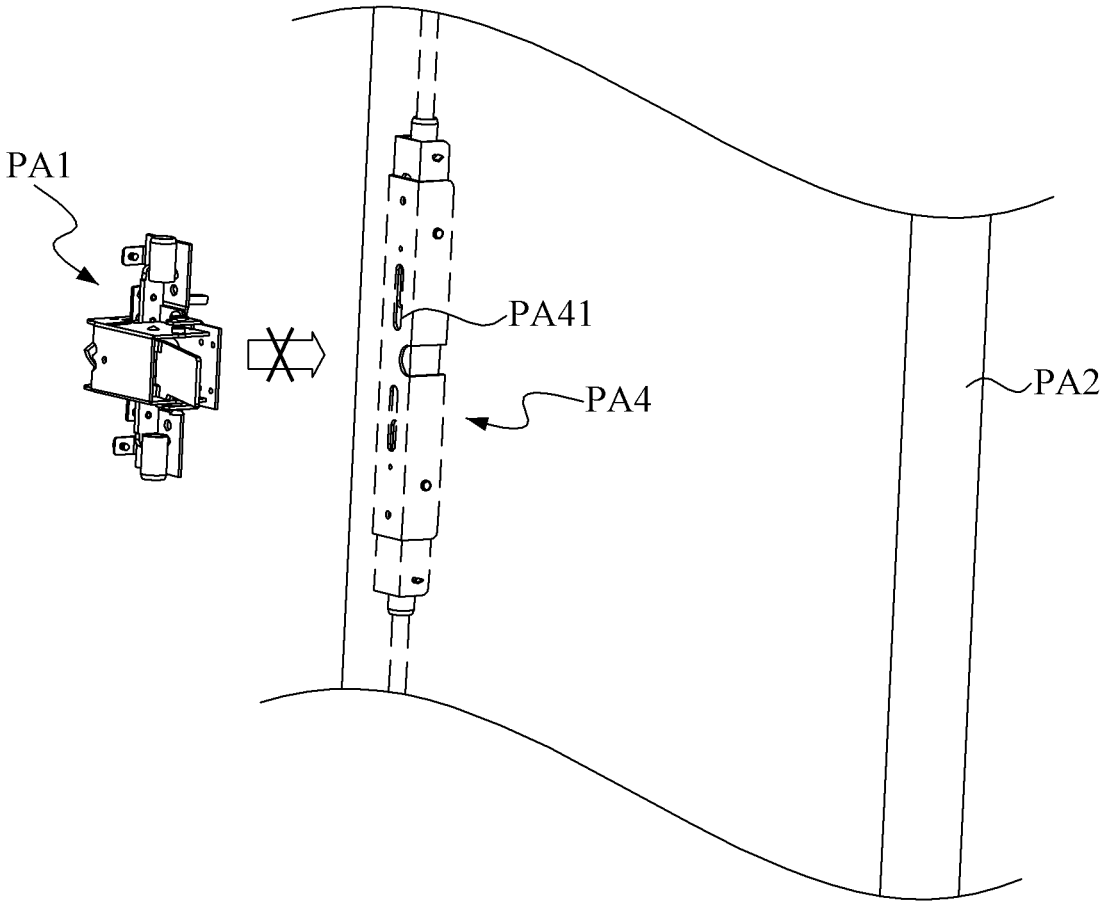
FIG.2(Prior Art)
FIG. 2 is a schematically perspective view showing the conventional door lock-driving assembly and an embedded vertical-extending lock bar assembly.
Figure 3:
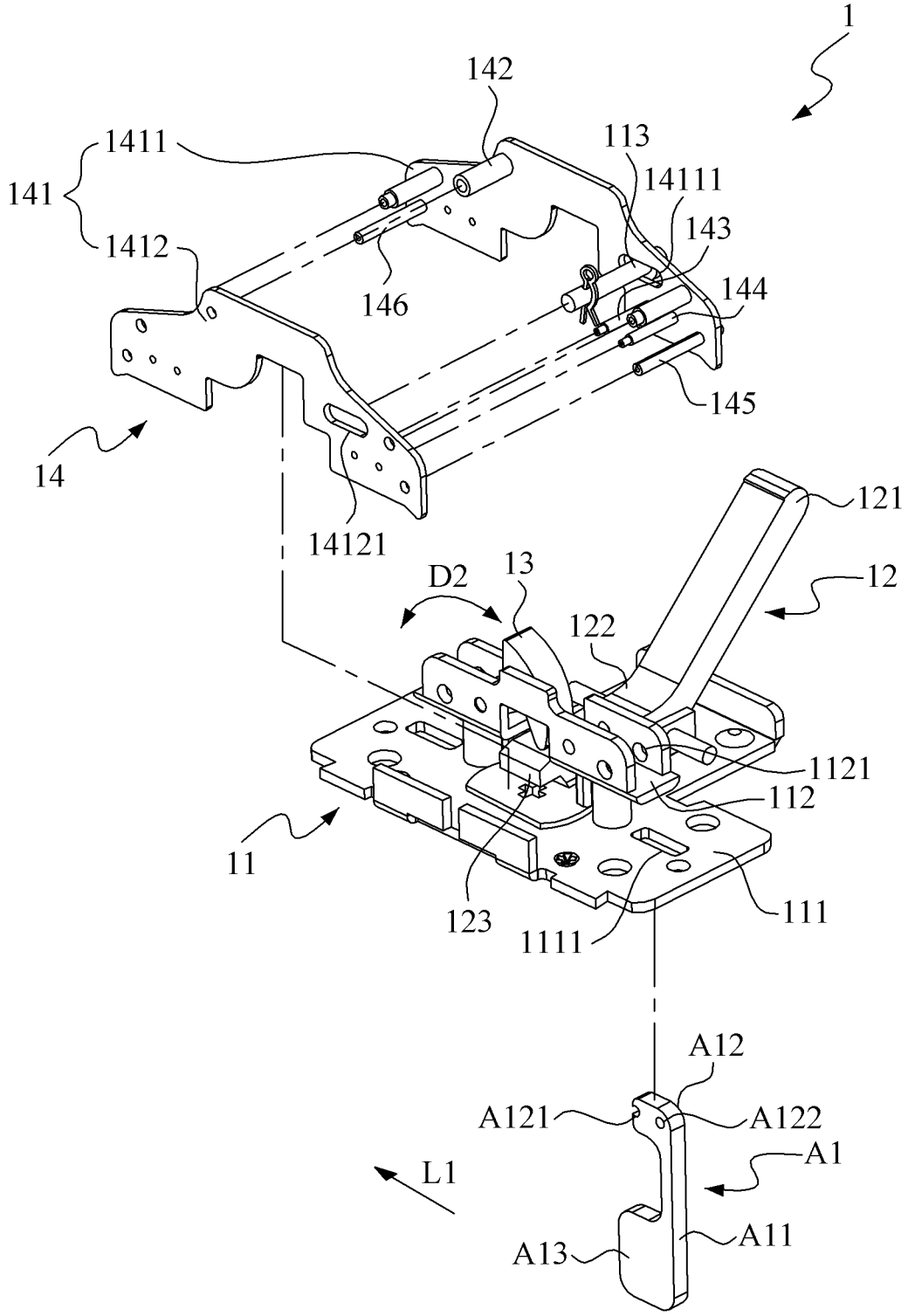
FIG. 3 is a schematically and largely exploded view of a first embodiment of the universal door lock-driving assembly in accordance with the present invention.
Figure 4:
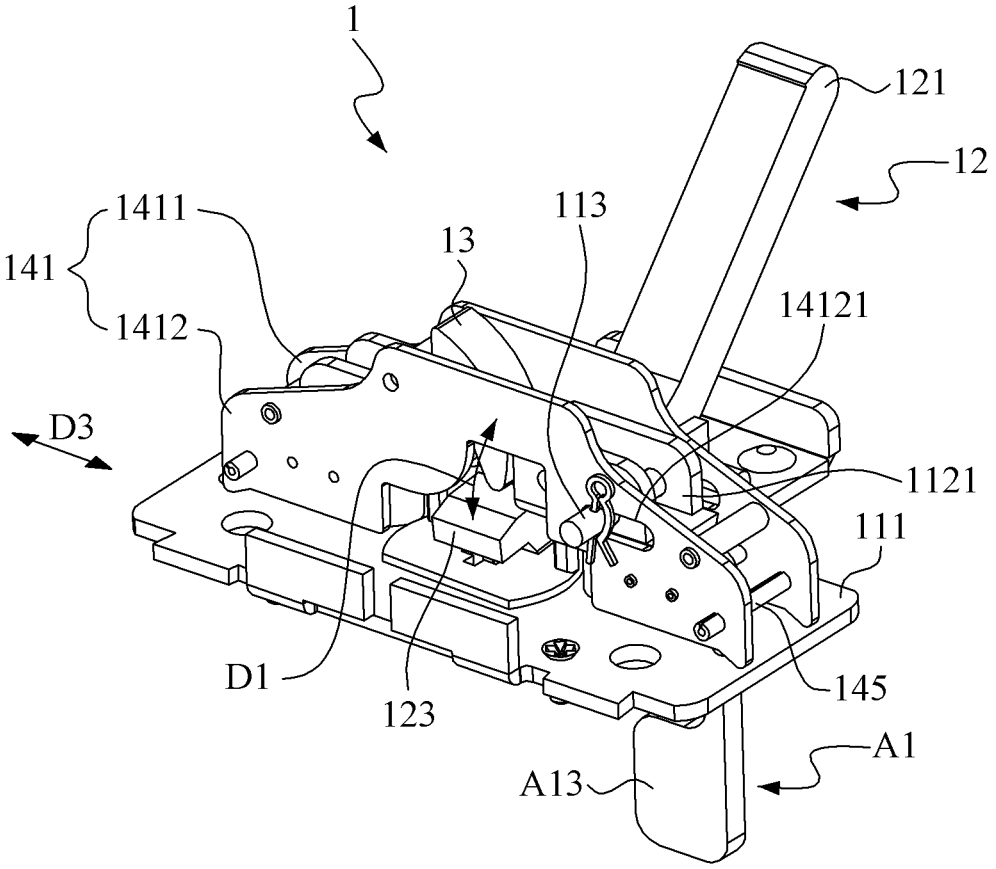
FIG. 4 is a schematically perspective view of FIG. 3.
Figure 5:
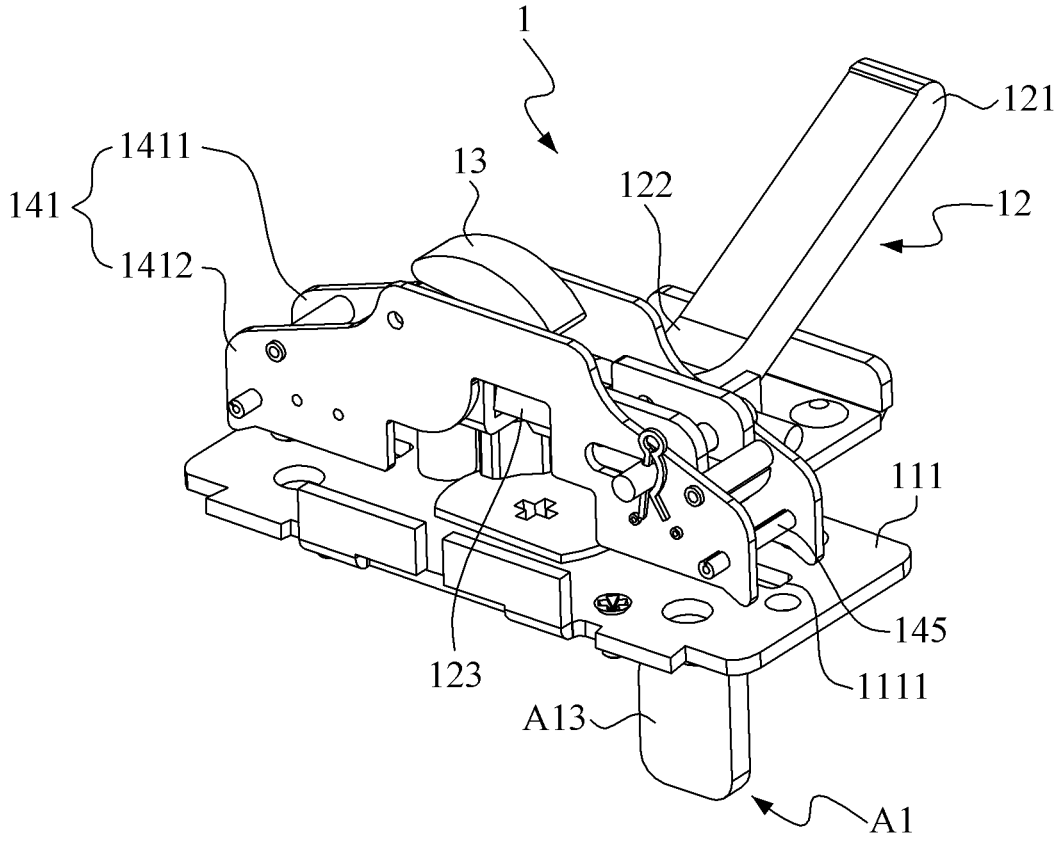
FIG. 5 shows another state of FIG. 4, in which an action unit is pushed to displace a slidable unit.
Figure 6:
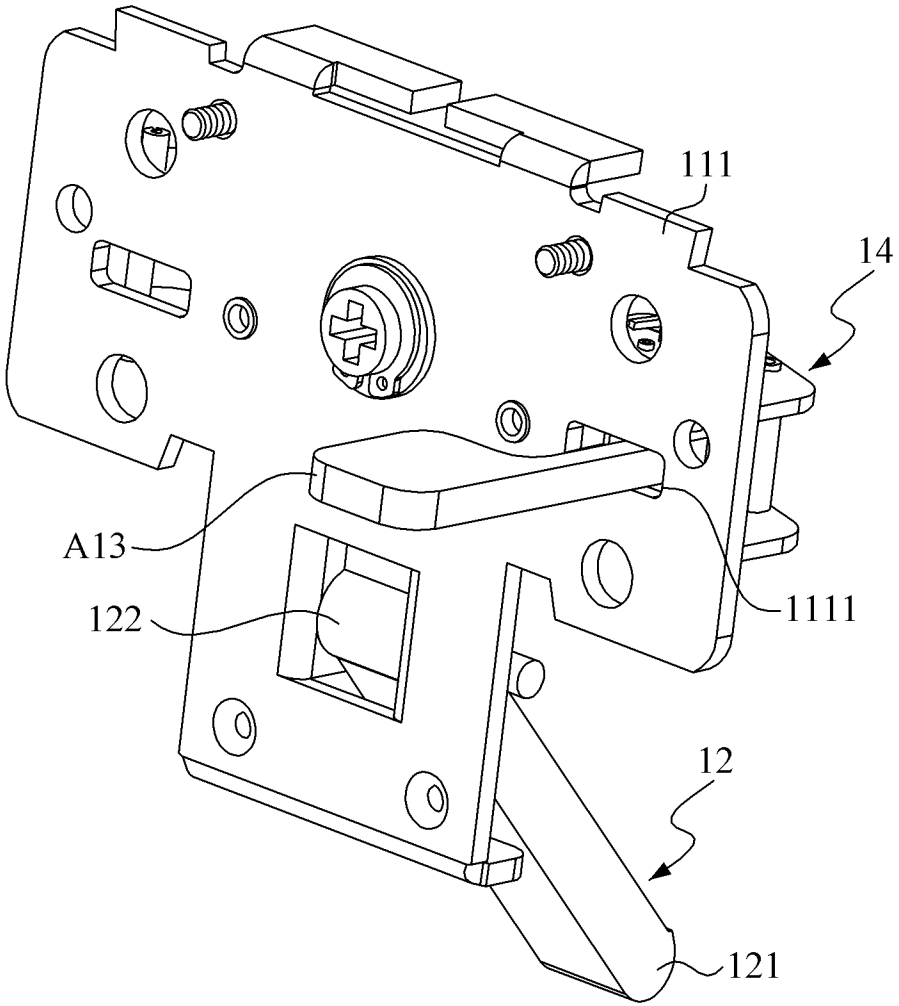
FIG. 6 is another view of FIG. 4.
Figure 7:
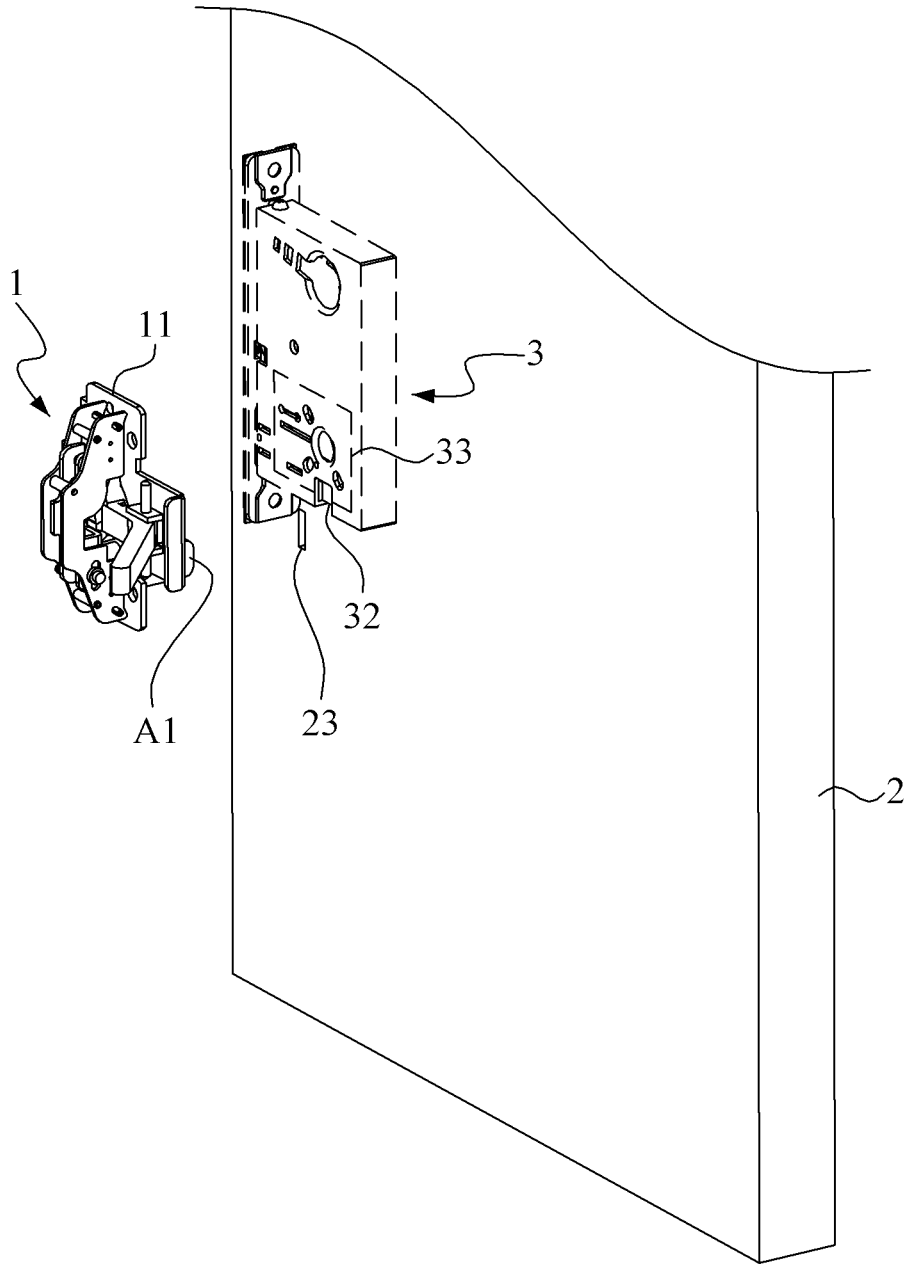
FIG. 7 is a schematically perspective view showing the first embodiment of the universal door lock-driving assembly and a door panel equipped with an embedded lock cartridge.

Refer now to FIG. 3 through FIG. 7; where FIG. 3 is a schematically and largely exploded view of a first embodiment of the universal door lock-driving assembly in accordance with the present invention applied for a door panel being furnished with an embedded lock cartridge, FIG. 4 is a schematically perspective view of FIG. 3, FIG. 5 shows another state of FIG. 4 that an action unit is pushed to displace a slidable unit, FIG. 6 is another view of FIG. 4, and FIG. 7 is a schematically perspective view showing the first embodiment of the universal door lock-driving assembly and a door panel equipped with an embedded lock cartridge.

Figure 9:
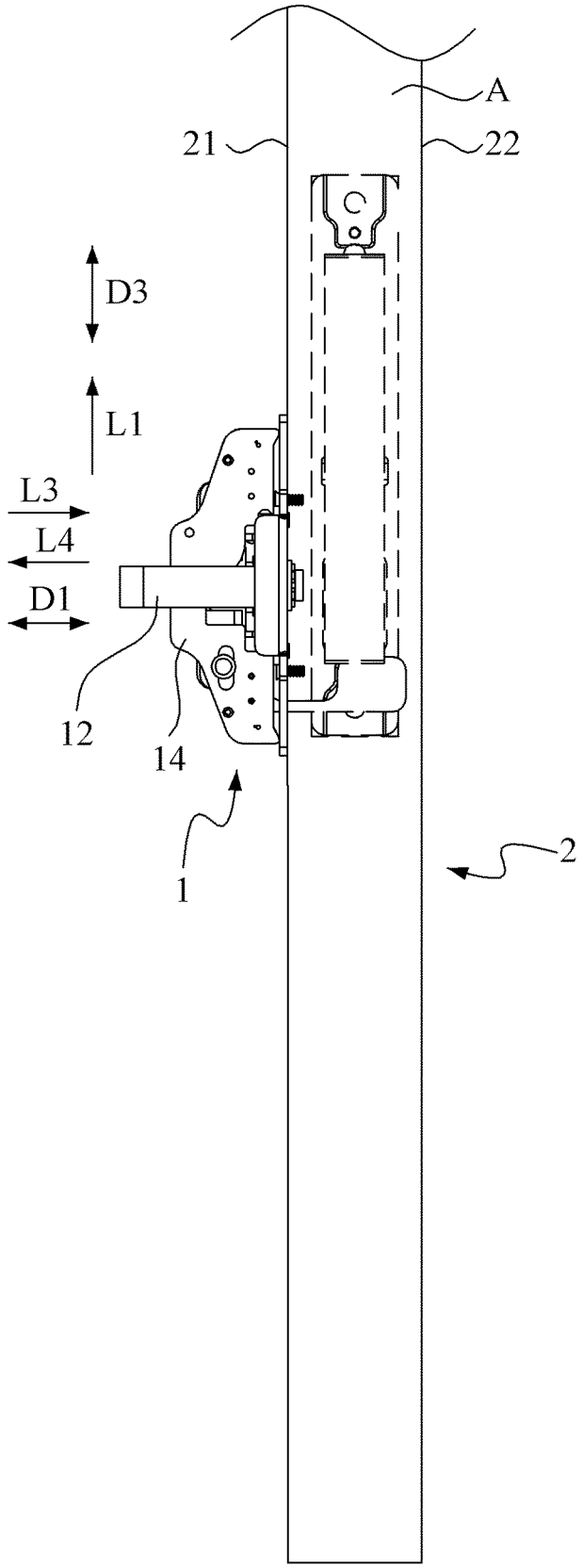
FIG. 9 is a schematic right-side view of FIG. 8.

As shown, the first embodiment of the universal door lock-driving assembly 1 is mounted in the exterior space of a door panel 2, in which the door panel 2 can be one for a fire door. The door panel 2 mainly includes two door plates 21 and 22 (as shown in FIG. 9), where the door plate 21 is substantially parallel to the door plate 22 by predetermined spacing so as to define an in-panel space A in between thereof. Thus, the aforesaid exterior space is defined to be an empty space other than the in-panel space A (i.e. the space out of the door plate 21 or the door plate 22). In addition, the door panel 2 having a through hole 23 can be equipped with an embedded lock cartridge 3, an embedded vertical-extending lock bar assembly 3*a* (refer to FIG. 13) or an exposed vertical-extending lock bar assembly having two exposed lock bars 31*b* and 32*b* (refer to FIG. 16).

Further, it shall be mentioned that the aforesaid embedded or exposed vertical-extending lock bar assembly includes an upper lock bar and a lower lock bar. Either of the upper and lower lock bars has a lock state and an unlock state. By having the upper lock bar as an example, an upper position of the upper lock bar is defined to be in the lock state, while a lower position thereof is defined to be in the unlock state. On the other hand, by having the lower lock bar as an example, an upper position of the lower lock bar is defined to be in the unlock state, while a lower position thereof is defined to be in the lock state.

In the first embodiment, the universal door lock-driving assembly 1 is applied to pair, i.e. to control, the embedded lock cartridge 3 installed in the in-panel space A of the door panel 2. In practice, the way for the embedded lock cartridge 3 to be notched into the door panel 2 can be a means of structural interference or screwing. Since the mounting means of the embedded lock cartridge 3 at the door panel 2 can apply the technique already mature in the art, thus details thereabout are omitted herein. In addition, the embedded lock cartridge 3 includes a locking tongue 31, a trigger aperture 32 and a turning member 33. The trigger aperture 32 is located preferably by closing to the through hole 23. However, in other embodiments, the position relationship between the trigger aperture and the through hole is not limited to the aforesaid configuration, but shall depend on practical needs. The turning member 33 is connected with the locking tongue 31, and located also by closing to the trigger aperture 32. The turning member 33 can include a cam, a linking bar, a gear set, and any the like. Also, the turning member 33 is preferably equipped with spring elements for ensuring contacts among elements. Since the turning member 33, already mature in the art, is any mechanism that can convert a linear motion in a first direction into another linear motion in a second direction, thus details thereabout are omitted herein.

In this first embodiment, the universal door lock-driving assembly 1 includes a base set 11, an action unit 12, a driving member 13, a slidable unit 14 and an embedded bar-ward lever A1. The base set 11 includes a basic plate 111, a mounting structure 112 and a position-limiting pin 113. The basic plate 111 can be, but not limited to be, screwed onto the door panel 2. The basic plate 111 further includes a penetration slot 1111 located at a position respective to the through hole 23 of the door panel 2. In this embodiment, the mounting structure 112 can be, but not limited to be, screwed onto the basic plate 111. In some other embodiments, the mounting structure 112 can be integrally manufactured with the basic plate 111 as a unique piece; for example, as an extension structure of the basic plate 111. In addition, the mounting structure 112 is further furnished with two opposing position holes 1121 (one labeled in the figure), and the position-limiting pin 113 is to penetrate through both of the position holes 1121.

The action unit 12, movably connected with the basic plate 111, includes an acting portion 121, a pivotal portion 122 and a depression portion 123. The acting portion 121 and the depression portion 123 are oppositely extended from the pivotal portion 122 as a unique piece. The pivotal portion 122 is pivotally mounted on the basic plate 111, so that the pivotal portion 122 can perform as a pivot point for both the acting portion 121 and the depression portion 123. Further, the depression portion 123 has an action stroke D1 along an arc contour.

As described above, when the acting portion 121 is depressed to undergo an angular displacement about the pivotal portion 122, the depression portion 123 would trace correspondingly along the action stroke D1 about the same pivotal portion 122 but in the other side of the pivotal portion 122.

The driving member 13, movably connected with the mounting structure 112, is located at a place on the action stroke D1 by closing to the depression portion 123. The driving member 13 has a lever-protruding stroke D2, where the lever-protruding stroke D2 is a turning stroke. In this embodiment, the driving member 13 can have, but not limited to, a shape of water drop. Practically, the shape of the driving member shall depend on the requirements. In addition, since the driving member 13 is located on the action stroke D1, thus, as the action unit 12 displaces pivotally along the action stroke D1, the driving member 13 would be driven by the depression portion 123 of the action unit 12 to move along the lever-protruding stroke D2.

The slidable unit 14, movably connected with the basic plate 111 (mainly vertical motions in the preferred embodiments), has a lock-sliding stroke D3 parallel to the door panel (as shown in FIG. 7). Also, the turning member 33 of the embedded lock cartridge 3 is located on the lock-sliding stroke D3. In this embodiment, the slidable unit 14 includes a slidable body 141, a slide-driven bar 142, two first assembling members 143 and 144, and a second assembling member 145.

The slidable body 141, movably located on the base set 1, includes a first sliding plate 1411 and a second siding plate 1412 parallel to the first sliding plate 1411 by a predetermined distance. The first sliding plate 1411 is furnished with a stroke-limiting slot 14111, while the second siding plate 1412 is furnished with another stroke-limiting slot 14121 respective to the stroke-limiting slot 14111. The aforesaid position-limiting pin 113 is to pass through the stroke-limiting slot 14121 so as to limit the motion of the slidable unit 14.

The slide-driven bar 142, assembled to a place between the first sliding plate 1411 and the second sliding plate 1412, is located on the lever-protruding stroke D2 for contacting directly the driving member 13. Namely, the driving member 13 located between the slide-driven bar 142 and the depression portion 123 actually contact directly both the slide-driven bar 142 and the depression portion 123, such that the pivotal motion of the action unit 12 along the action stroke D1 can be applied to drive the driving member 13 to undergo a corresponding pivotal motion along the lever-protruding stroke D2, and further to drive the slidable unit 14 to displace. Since the position-limiting pin 113 is fixedly mounted to the mounting structure 112, thus the slidable unit 14 would be pushed to move by the driving member 13. With the constraints provided by the stroke-limiting slots 14111, 14121 and the position-limiting pin 113, the motion of the slidable unit 14 would be allowed only to follow the lock-sliding stroke D3.

The two first assembling members 143 and 144 are assembled closely to be located between the first sliding plate 1411 and the second siding plate 1412. The second assembling member 145, also assembled between the first sliding plate 1411 and the second siding plate 1412, is located at one end portion of the slidable body 141, outside to the first assembling members 143 and 144 with respect to the slidable body 141. In this embodiment, the two first assembling members 143, 144 and the second assembling member 145 are all embodied as bar or pin structures.

The cartridge-ward lever A1 includes a lever body A11, a mounting portion A12 and a hook portion A13. The lever body A11 integrates, as a unique piece, the mounting portion A12 at one end thereof and the hook portion A13 at another end thereof. The mounting portion A12 is fixedly assembled to the first assembling members 143 and 144. The hook portion A13 is protruded from the lever body A11 in a first direction L1 parallel to the door panel 2 (as shown in FIG. 9). The mounting portion A12 is further furnished with two position holes A121 and A122. In a practical assembly, the mounting portion A12 firstly passes through the penetration slot 1111, and then the two first assembling members 143 and 144 penetrate the two position holes A121 and A122, respectively, such that the cartridge-ward lever A1 and the slidable unit 14 can move synchronously.

As described above, the cartridge-ward lever A1 of this embodiment is mainly applied to the situation that the door panel 2 is equipped with the embedded lock cartridge 3 and the universal door lock-driving assembly 1 is introduced to drive the embedded lock cartridge 3. The cartridge-ward lever A1 has the mounting portion A12 at one end thereof to connect the slidable unit 14, and has the hook portion A13 at another end thereof close to the turning member 33. Practically, in this first embodiment, the cartridge-ward lever A1 is assembled to the first assembling members 143 and 144 by screwing, buckling or integrating as a unique piece. Also, the cartridge-ward lever A1 penetrating the through hole 23 and the penetration slot 1111 is movable to some degree in the through hole 23 and the penetration slot 1111, so that the slidable unit 14 can drive the cartridge-ward lever A1 to displace along the lock-sliding stroke D3.

Figure 8:
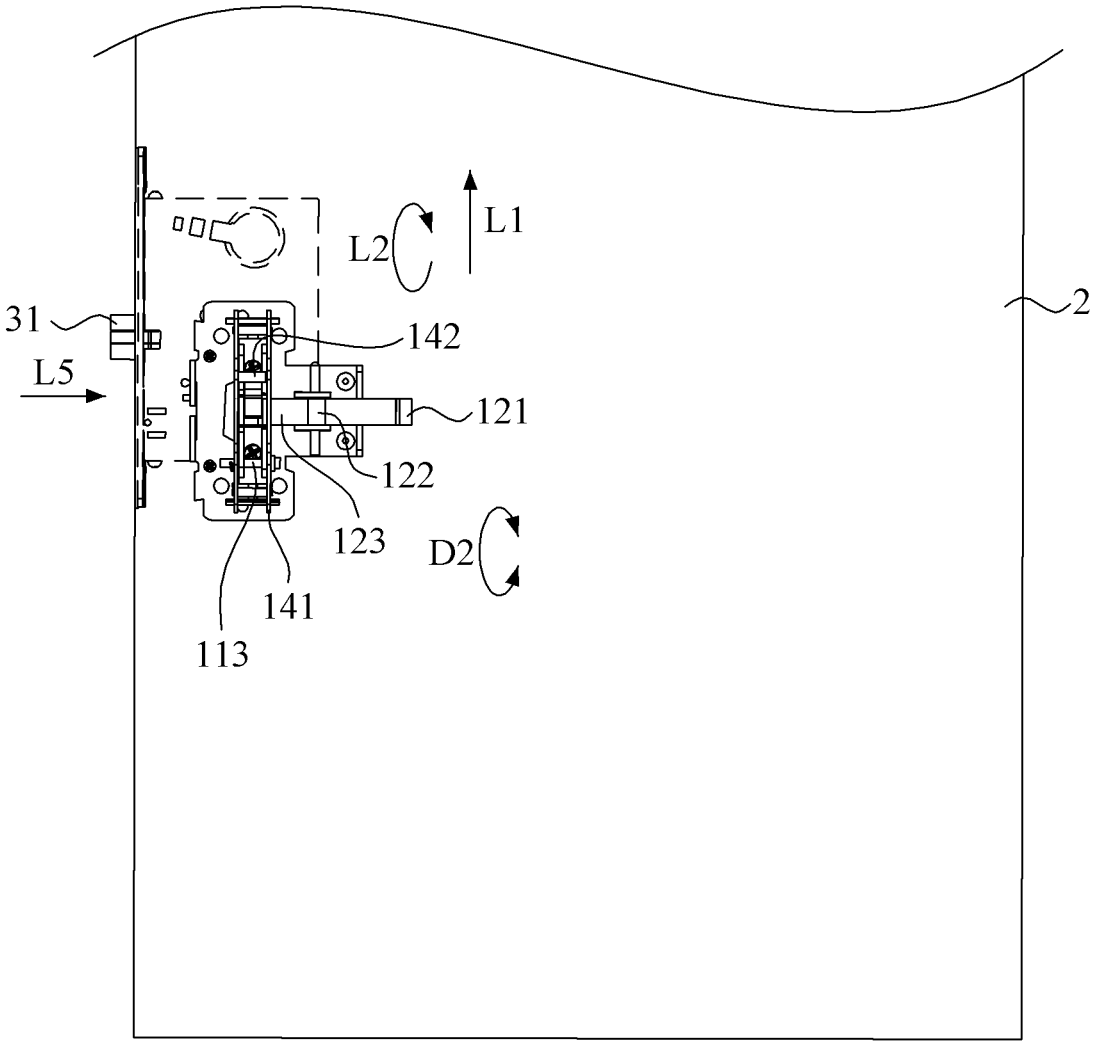
FIG. 8 is a schematic front view showing an engagement of the universal door lock-driving assembly and the embedded lock cartridge of FIG. 7.

Refer now to FIG. 7 through FIG. 9; where FIG. 8 is a schematic front view showing an engagement of the universal door lock-driving assembly and the embedded lock cartridge of FIG. 7, and FIG. 9 is a schematic right-side view of FIG. 8. As shown, when the acting portion 121 is depressed to move along the action stroke D1 in a second direction L3 (in these figures, the angular motion along an arc contour is simply symbolized by a straight line), the depression portion 123 would move along the action stroke D1 in a third direction L4 (again, in these figures, the angular motion along an arc contour is simply symbolized by a straight line) to contact the driving member 13, such that the driving member 13 can move along the lever-protruding stroke D2 in the turning direction L2 and push the slide-driven bar 142 to co-move the slidable body 141 of the slidable unit 14 along the lock-sliding stroke D3 in the first direction L1 (simultaneously, the position-limiting pin 113 is also moved in the first direction L1 within the stroke-limiting slots 14111 and 14121). Thereupon, the slidable body 141 can drive the cartridge-ward lever A1 synchronously to move along the lock-sliding stroke D3 in the first direction L1, so that the hook portion A13 can approach the trigger aperture 32 and finally push the turning member 33 (at this time, the position-limiting pin 113 is moved to ends of the stroke-limiting slots 14111 and 14121). Thereby, the turning member 33 would be driven to change its status from one in the first direction L1 to another one in a fourth direction L5 perpendicular to the first direction L1, such that the locking tongue 31 would be retrieved to unlock the door panel 2. In the art, various means can be applied to carry out the aforesaid operation in the lock cartridge, and thus details thereabout would be omitted herein.

In addition, in the aforesaid description upon the first embodiment of the present invention, the cartridge-ward lever A1 applies two first assembling members 143 and 144 to mount fixedly the cartridge-ward lever A1, so that possible rotation of the cartridge-ward lever A1 with respect to the slidable unit 14 can be avoided. However, the aforesaid application of the two first assembling members 143 and 144 to assemble the cartridge-ward lever A1 shall not limit the scope of the present invention. Practically, in some other embodiments, a single first assembling member can be also applied, but the first assembling member should be shaped to be square, rectangle, polygonal or any non-circle; such that the rotation of the cartridge-ward lever A1 with respect to the slidable unit 14 can be avoided.

Figure 10:
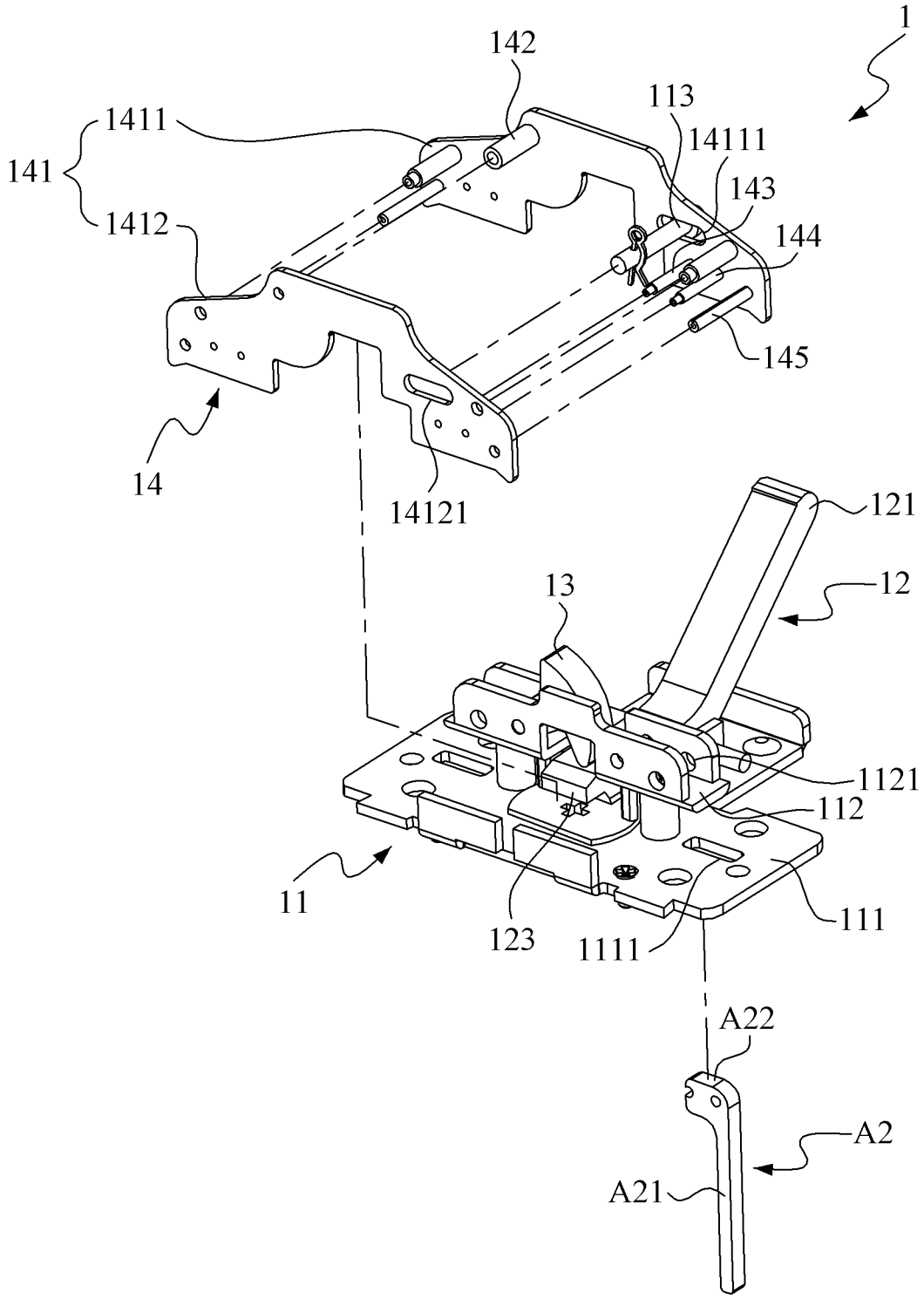
FIG. 10 is a schematically and largely exploded view of a second embodiment of the universal door lock-driving assembly in accordance with the present invention.
Figure 11:
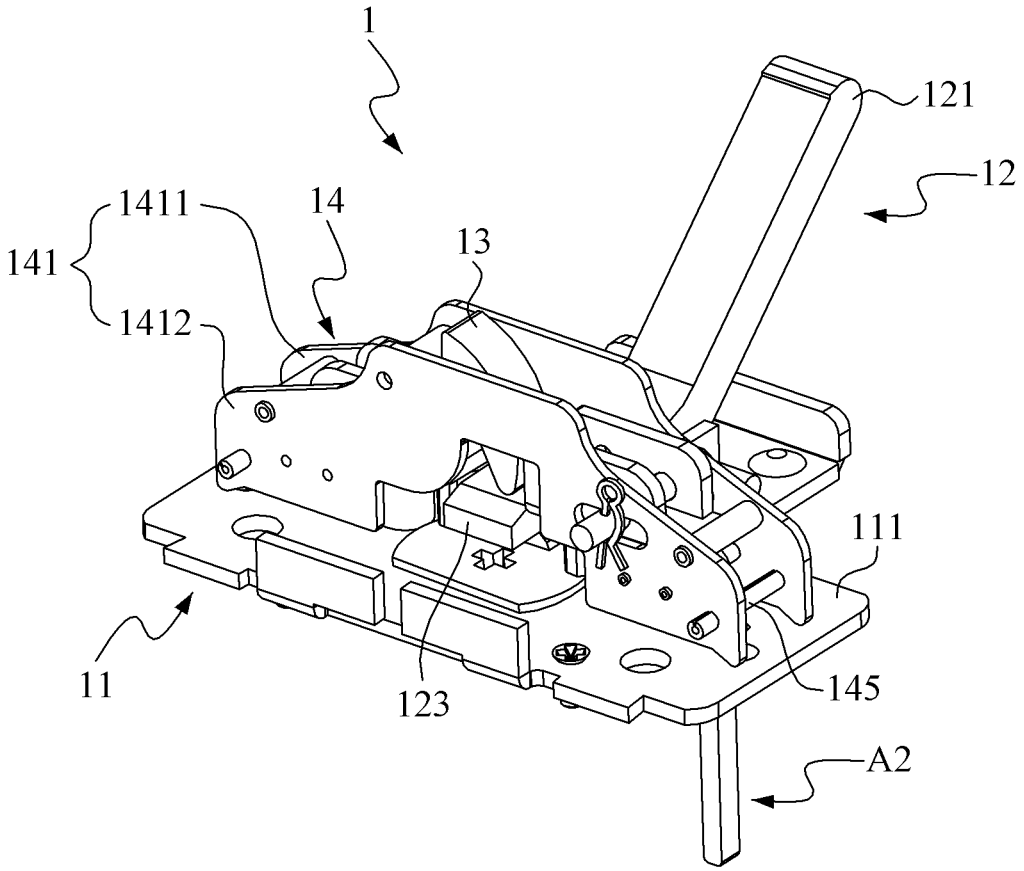
FIG. 11 is a schematically perspective view of FIG. 10.
Figure 12:
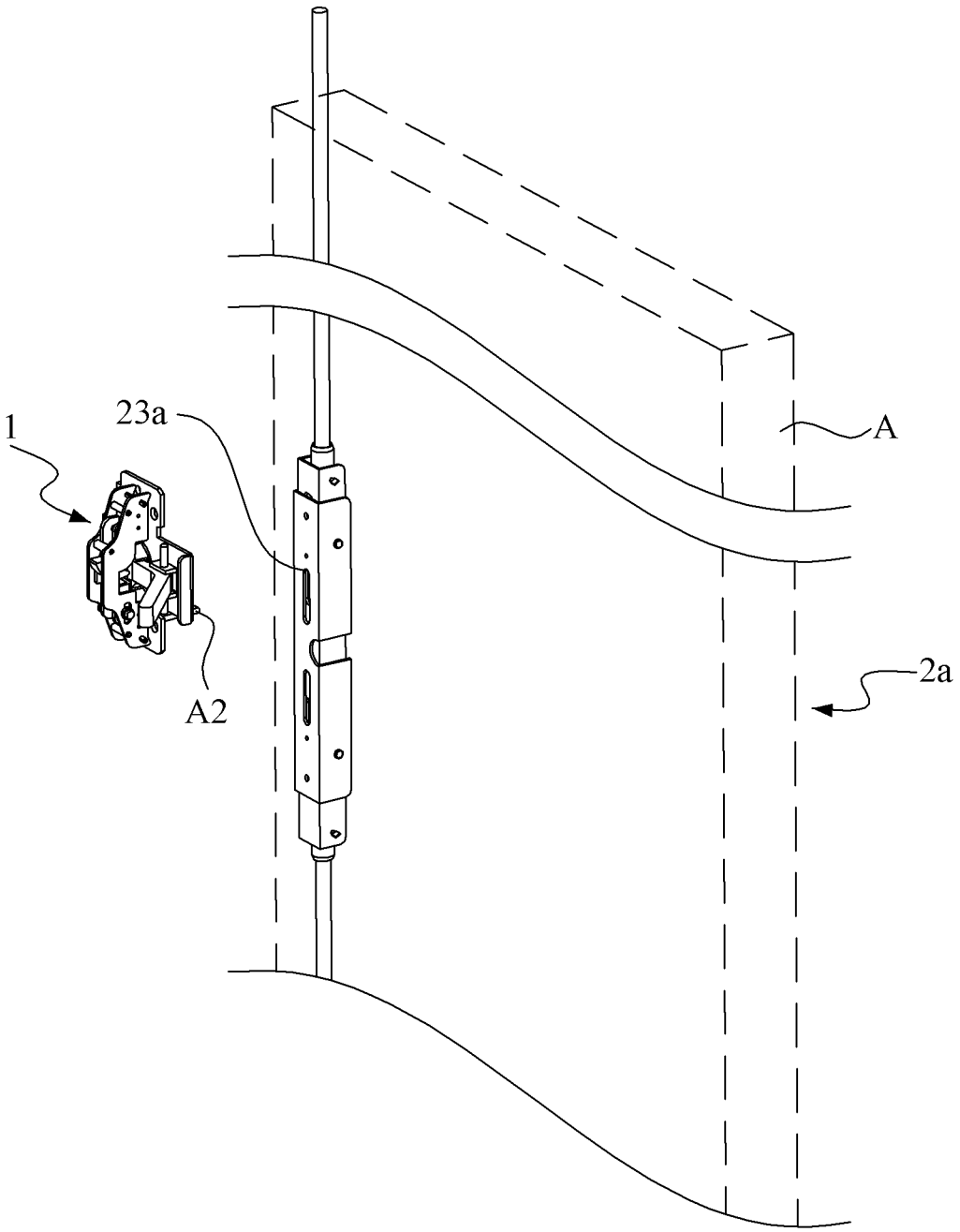
FIG. 12 is a schematically perspective view showing the second embodiment of the universal door lock-driving assembly and the door panel equipped with an embedded vertical-extending lock bar assembly.
Figure 13:
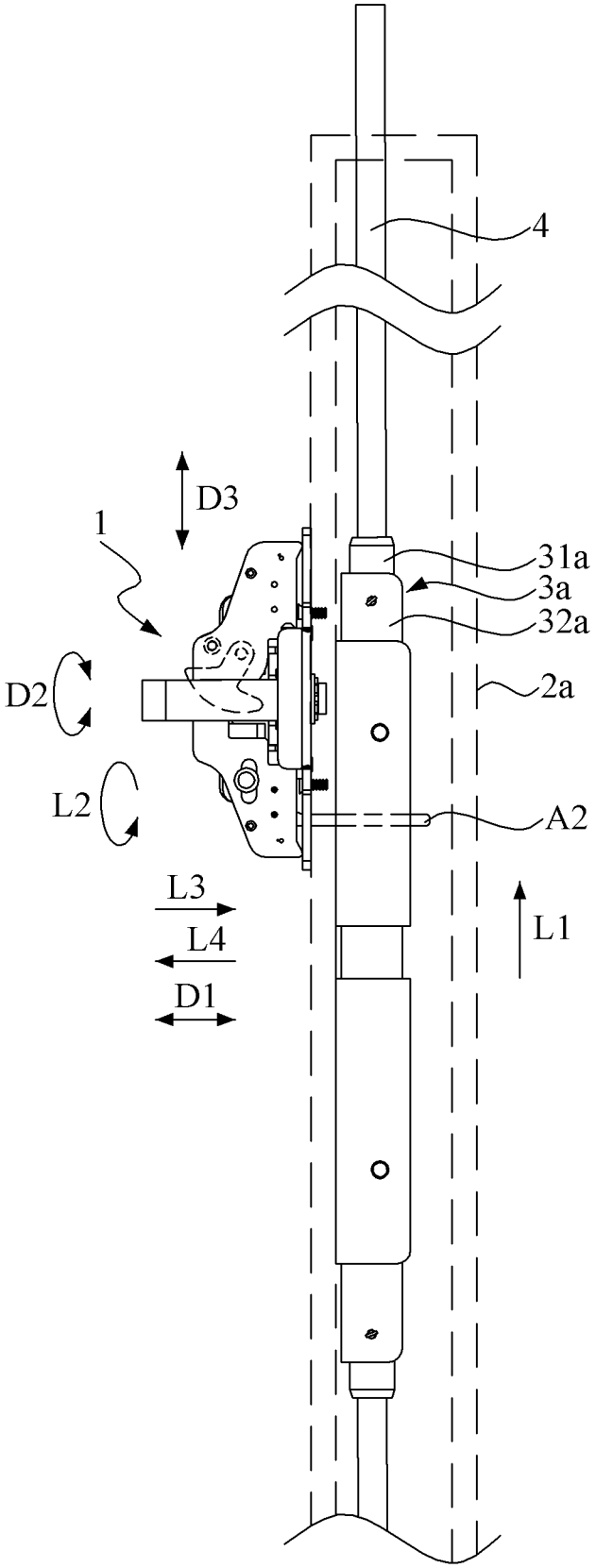
FIG. 13 is a schematically perspective view showing an engagement of the universal door lock-driving assembly and the embedded vertical-extending lock bar assembly of FIG. 12.

Refer now to FIG. 10 through FIG. 13; where FIG. 10 is a schematically and largely exploded view of a second embodiment of the universal door lock-driving assembly in accordance with the present invention applied for a door panel being furnished with an embedded vertical-extending lock bar assembly, FIG. 11 is a schematically perspective view of FIG. 10, FIG. 12 is a schematically perspective view showing the second embodiment of the universal door lock-driving assembly and the door panel equipped with an embedded vertical-extending lock bar assembly, and FIG. 13 is a schematically perspective view showing an engagement of the universal door lock-driving assembly and the embedded vertical-extending lock bar assembly of FIG. 12.

As shown, in this second embodiment, the universal door lock-driving assembly 1 is installed in the exterior space of the door panel 2*a*, and the door panel 2*a* is equipped with an embedded vertical-extending lock bar assembly 3 in the in-panel space A thereof. Similar to the aforesaid first embodiment, the door panel 2*a* is furnished with a through hole 23*a*. The embedded vertical-extending lock bar assembly 3*a* includes at least a first push rod 31*a* and a rod-driving member 32*a* for driving the first push rod 31*a*. Namely, the rod-driving member 32*a* and the first push rod 31*a* are coupled. The first push rod 31*a* is further connected with an embedded lock bar 4.

As described above, as the universal door lock-driving assembly 1 is applied to drive the embedded vertical-extending lock bar assembly 3*a* in the door panel 2*a*, the first assembling members 143 and 144 are used to assemble an embedded bar-ward lever A2. The embedded bar-ward lever A2 includes a lever body A21 and a mounting portion A22. The lever body A21 is formed as a pillar structure. The mounting portion A22, similar to the aforesaid mounting portion A12 of the foregoing first embodiment, is to pass through the penetration slot 1111 and then to be fixed to the first assembling members 143 and 144 via two corresponding position holes thereof (not shown in the figure). While the universal door lock-driving assembly 1 is mounted onto the door panel 2*a*, the lever body A21 penetrates the through hole 23*a* respective to the penetration slot 1111, and then connects the embedded vertical-extending lock bar assembly 3*a* in a co-moving manner. In addition, the rod-driving member 32*a* of the embedded vertical-extending lock bar assembly 3*a* is located at a position on the lock-sliding stroke D3.

Referring now further to FIG. 12 and FIG. 13, as the acting portion 121 of the second embodiment is depressed, the acting portion 121 is moved pivotally about the pivotal portion 122 along the action stroke D1 in the second direction L3 (an arc tour actually), while the depression portion 123 is also moved pivotally along the action stroke D1 but in the third direction L4 (an arc tour actually) so as to push directly the driving member 13. Thereupon, the driving member 13 would move along the lever-protruding stroke D2 in the turning direction L2 so as to have the slide-driven bar 1411 to drive the slidable body 141 of the slidable unit 14 to displace along the lock-sliding stroke D3 in the first direction L1. Thereby, the embedded bar-ward lever A2 would move synchronously in the first direction L1 and further drive the rod-driving member 32*a* to displace in the first direction L1. Accordingly, the first push rod 31*a* and the embedded lock bar 4 would undergo a linear vertical displacement along the first direction L1 to unlock the door panel 2*a*. Upon such an arrangement, the fire door can be easily pushed to open. Since various ways of unlocking the door panel can be found in the art and the aforesaid unlocking means is not the claimed object of this present invention, thus details thereabout would be omitted herein. Also, all other details of the second embodiment are resembled to those of the first embodiment, thus descriptions thereabout are omitted herein. In particular, it is noted that, in this second embodiment, the motion in the first direction L1 is to perform unlocking. However, in some other embodiments, a motion in a reverse direction may be defined as the motion to unlock the door panel.

Figure 14:
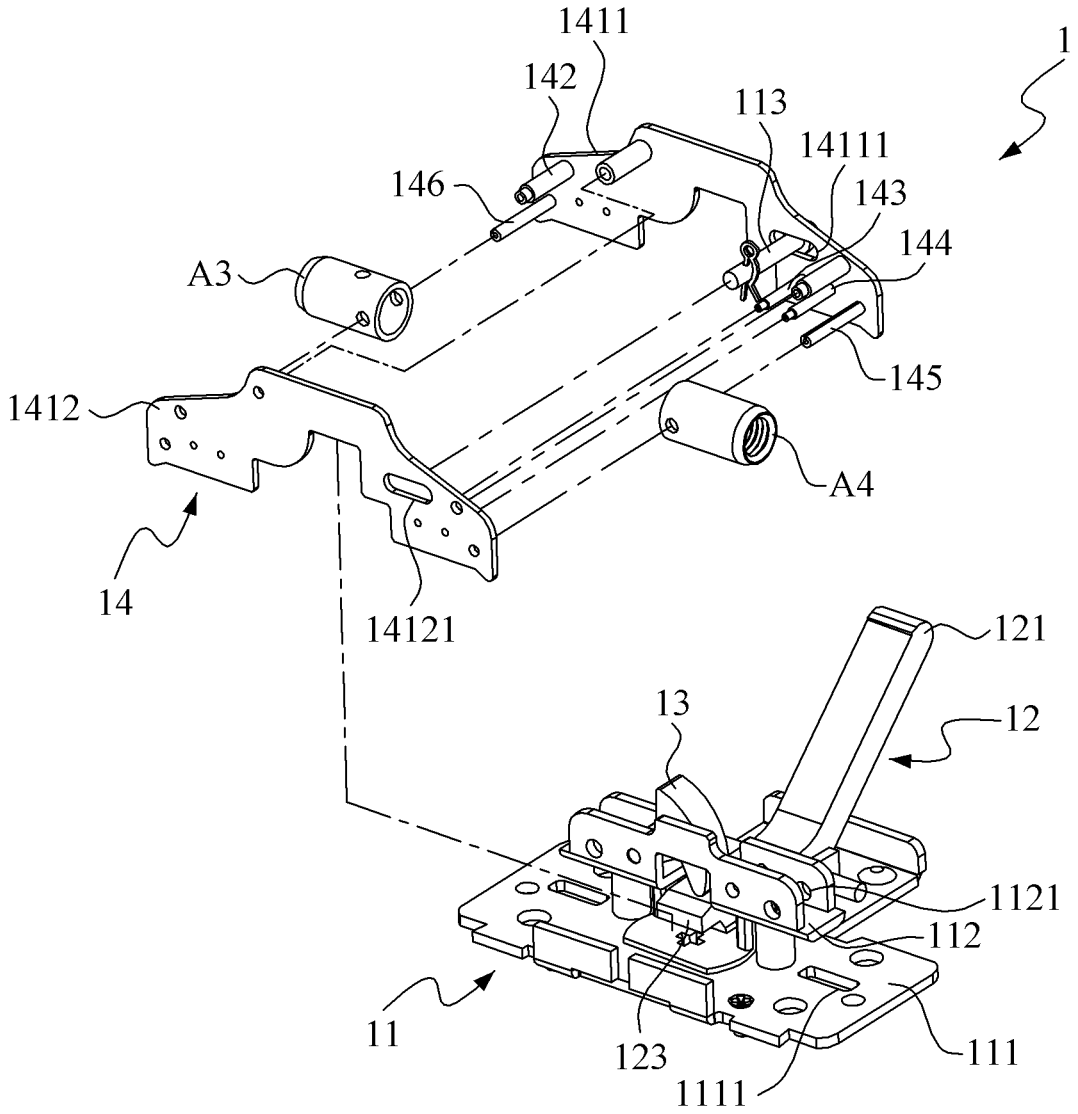
FIG. 14 is a schematically and largely exploded view of a third embodiment of the universal door lock-driving assembly in accordance with the present invention.
Figure 15:
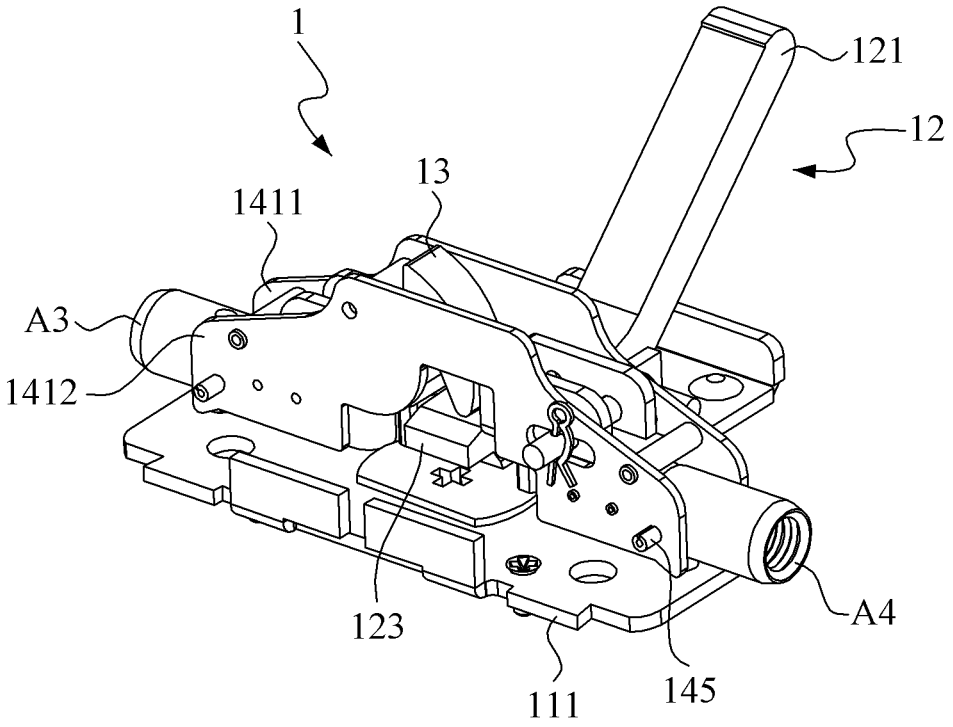
FIG. 15 is a schematically perspective view of FIG. 14.
Figure 16:
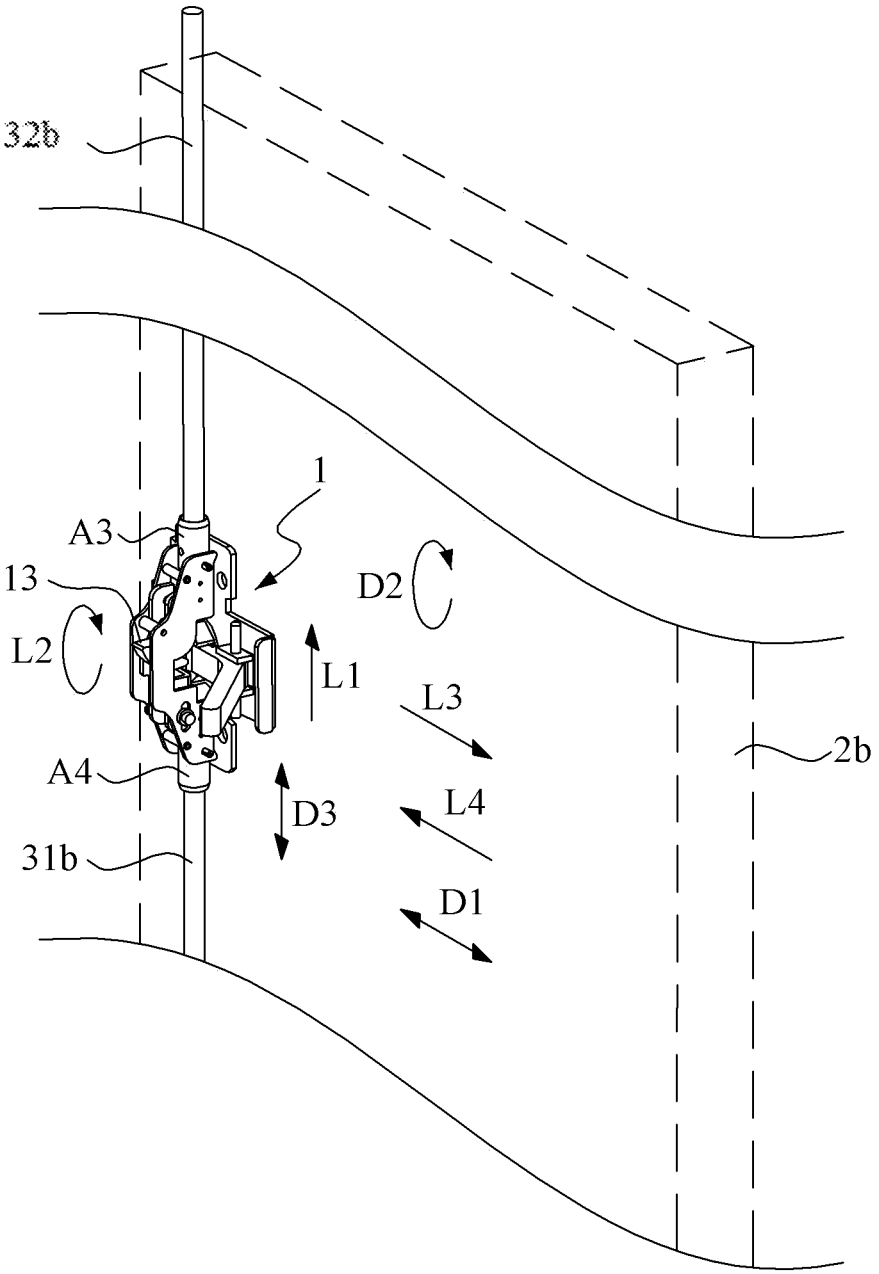
FIG. 16 is a schematically perspective view showing an engagement of the third embodiment of the universal door lock-driving assembly and an exposed vertical-extending lock bar assembly.

Refer now to FIG. 14 through FIG. 16; where FIG. 14 is a schematically and largely exploded view of a third embodiment of the universal door lock-driving assembly in accordance with the present invention applied for a door panel being furnished with an exposed vertical-extending lock bar assembly, FIG. 15 is a schematically perspective view of FIG. 14, and FIG. 16 is a schematically perspective view showing an engagement of the third embodiment of the universal door lock-driving assembly and an exposed vertical-extending lock bar assembly. As shown, the third embodiment of the universal door lock-driving assembly 1*b* is applied to control a conventional exposed vertical-extending lock bar assembly 3*b* having two exposed lock bars. The universal door lock-driving assembly 1*b* is mounted in the exterior space of the door panel 2*b* equipped with the exposed vertical-extending lock bar assembly 3*b*. The universal door lock-driving assembly 1*b* is furnished with two exposed bar-ward levers A3 and A4.

As described above, the universal door lock-driving assembly 1*b* is installed in the exterior space of the door panel 2*b*, which is largely and structurally resembled to that of the aforesaid first embodiment. However, a difference in between is that the exterior space of the door panel 2*b* is furnished with at least one exposed lock bar 3*b*. The door panel 2*b* has a through hole (not shown in the figure). The exposed lock bar 3*b* is located to undergo the lock-sliding stroke D3. The two second assembling members 145 and 146 of the slidable unit 14 are individually assembled with respective exposed bar-ward levers A4 and A3. By having the exposed bar-ward lever A3 as an example, the exposed lock bar 3*b* is screwed to connect the exposed bar-ward lever A3. In some other embodiments, the aforesaid connection means may be various but simply determined according to practical requirements.

As described above, when the acting portion 121 is depressed to move pivotally along the action stroke D1 in the second direction L3 (a linear line in the figure, but precisely an arc actually), then the depression portion 123 would move pivotally along the action stroke D1 in the third direction L4 (a linear line in the figure, but precisely an arc actually) do as further to push the driving member 13. Then, the driving member 13 rotates along the lever-protruding stroke D2 In the turning direction L2 so as to have the slide-driven bar 1411 to drive the slidable unit 14 to displace along the lock-sliding stroke D3 in the first direction L1. Thereupon, the slidable unit 14 can drive the second lock bar 32*b* to undergo a linear perpendicular displacement in the first direction L1 to unlock the door panel 3*b*. Thus, the fire door can be easily open. Since various ways of unlocking the door panel can be found in the art and the aforesaid unlocking means is not the claimed object of this present invention, thus details thereabout would be omitted herein.

Commercially, by having the aforesaid first embodiment of the present invention as a basic embodiment, the universal door lock-driving assembly 1 includes basically the basic plate 111, the slidable unit 14, the mounting structure 112, the driving member 13, the action unit 12 and the cartridge-ward lever A1. In addition, the universal door lock-driving assembly 1 can further include the embedded bar-ward lever A2 of the second embodiment and the exposed bar-ward lever A3 of the third embodiment. Thus, as long as the type of the door lock is determined, the choice of the cartridge-ward lever A1, the embedded bar-ward lever A2 and the exposed bar-ward lever A3 can be determined for being assembled to the first assembling members 143, 144 or the second assembling member 145 of the slidable unit 14. Thereupon, usage effectiveness and convenience can be substantially enhanced. In addition, since the second assembling member 145 is located outside of the first assembling members 143, 144 with respect to the slidable unit 14, thus the assembling of the embedded bar-ward lever A2 to the second assembling member 145 won't conflict structurally with the first assembling members 143, 144.

In summary, by adopting the universal door lock-driving assembly provided by the present invention, the cartridge-ward lever, the embedded bar-ward lever and the exposed bar-ward lever are optional to the basic structure of the door lock-driving assembly, and commonly assembled to the same slidable unit. Also, since either of the cartridge-ward lever and the embedded bar-ward lever is movably to penetrate both the penetration slot additional to the base set and the through hole additional to the door panel, thus each of which can be extended to drive the locking tongue or the lock bar for performing locking or unlocking of the door panel. In addition, the slidable unit can similarly assemble the exposed bar-ward lever to drive the exposed lock bar. Thereupon, the universal door lock-driving assembly provided in the present invention can be successfully applied to different door locks, and thus the aforesaid shortcomings in the conventional designs can be effectively resolved.

While the present invention has been particularly shown and described with reference to a preferred embodiment, it will be understood by those skilled in the art that various changes in form and detail may be without departing from the spirit and scope of the present invention.

What is claimed is:

1. A universal door lock-driving kit for creating different door lock driving assemblies, universally installed in an exterior space of a door panel furnished with either one of an embedded lock cartridge, an embedded vertical-extending lock bar assembly or an exposed vertical-extending lock bar assembly, the door panel having a through hole, the embedded lock cartridge having a locking tongue and a turning member to drive the locking tongue, the embedded vertical-extending lock bar assembly having at least a first push rod and a rod-driving member for driving the first push rod, the exposed vertical-extending lock bar assembly having at least one lock bar, the universal door lock-driving kit comprising:

a base set, comprising a basic plate connected with the door panel and having a penetration slot respective to the through hole, and a mounting structure;

an action unit, pivotably connected to the basic plate and movably along an action stroke;

a driving member, pivotably connected to the mounting structure of the base set, located on the action stroke, moving along a lever-protruding stroke by the action unit; and a slidable unit, connected with the mounting structure of the base set and movable along the basic plate, located on the lever-protruding stroke, the slidable unit having at least a first assembling member and a second assembling member, a slide-driven bar configured to be contacted by the driving member, a first sliding plate and a second sliding plate positioned to enclose the mounting structure and connected to each other by the least first and second assembling members, and a position-limiting pin connecting the slidable unit to the base set; wherein, if the door panel is equipped with the embedded lock cartridge, one of the different door lock driving assemblies is provided with a cartridge-ward lever fixedly secured to the first and second assembling members and configured to penetrate through the penetration slot and the through hole to operate the turning member to move the locking tongue;

wherein, if the door panel is equipped with the embedded vertical-extending lock bar assembly, another one of the different door lock driving assembles is provided with an embedded bar-ward lever fixedly secured to the first and second assembling members and configured to penetrate through the penetration slot and the through hole to operate the rod-driving member to move the first push rod;

wherein, if the door panel is equipped with the exposed vertical-extending lock bar assembly, another one of the different door lock driving assembles is provided with an exposed bar-ward coupling configured to couple to the at least one lock bar so that movement of the slidable unit operates the at least one lock bar;

wherein the driving member drives the slidable unit to move along a lock-sliding stroke;

wherein the turning member of the embedded lock cartridge, the rod-driving member of the embedded vertical-extending lock bar assembly, and the lock bar of the exposed vertical-extending lock bar assembly are located on the lock-sliding stroke.

2. The universal door lock-driving kit for creating different door lock driving assemblies of claim 1, wherein the first sliding plate and the second sliding plate are furnished with at least one stroke-limiting slot, the slide-driven bar being connected with the first sliding plate and the second sliding plate.

3. The universal door lock-driving kit for creating different door lock driving assemblies of claim 2, wherein the action unit includes:

an acting portion, for being depressed to move pivotally the action unit;

a pivotal portion, connected with the acting portion, pivotally mounted to the basic plate; and a depression portion, connected with the pivotal portion, being to push the driving member;

wherein, as the acting portion is depressed, the depression portion is moved pivotally about the pivotal portion along the action stroke to push the driving member, and then the driving member moves along the lever-protruding stroke to drive the slide-driven bar and the slidable unit to displace along the lock-sliding stroke.

4. The universal door lock-driving kit for creating different door lock driving assemblies of claim 3, wherein the depression portion is located between the basic plate and the slidable unit.

5. The universal door lock-driving kit for creating different door lock driving assemblies of claim 1, wherein the lever-protruding stroke is a turning stroke.

6. The universal door lock-driving kit for creating different door lock driving assemblies of claim 1, wherein the lock-sliding stroke is parallel to the door panel.

7. The universal door lock-driving kit for creating different door lock driving assemblies of claim 1, wherein the first assembling member is located respective to the penetration slot.

* * * * *